US007421956B1

(12) United States Patent
McCarthy et al.

(10) Patent No.: US 7,421,956 B1
(45) Date of Patent: Sep. 9, 2008

(54) BASKET WITH EXTENDABLE LEGS

(76) Inventors: Clive McCarthy, 115 Marsh Dr., West Hendon (GB) NW9; Dean Peter Carrick, 25 Bluegate, Godmanchester, Cambridgeshire (GB) PE29 2EZ ( * ) Notice: Subject to any disclaimer, the term of this patent is extended or adjusted under 35 U.S.C. 154(b) by 1138 days.

(21) Appl. No.: 10/621,101

(22) Filed: Jul. 16, 2003

(51) Int. Cl.
*A47B 85/00* (2006.01)

(52) U.S. Cl. ..... 108/25; 108/147.21

(58) Field of Classification Search ..... 108/147.21, 108/147.11, 147.19, 144.11, 144.2, 116, 108/25, 115; 248/188.5
See application file for complete search history.

(56) References Cited

U.S. PATENT DOCUMENTS

| | | | | |
|---|---|---|---|---|
| 1,645,683 | A * | 10/1927 | Beck | 108/146 |
| 2,604,334 | A * | 7/1952 | Schultz | 108/147.19 |
| 3,191,902 | A * | 6/1965 | Goller | 248/188.5 |
| 5,479,866 | A * | 1/1996 | Rae | 108/44 |
| 6,032,586 | A * | 3/2000 | Reyes | 108/43 |
| 6,439,133 | B1 * | 8/2002 | Jaramillo | 108/25 |
| 6,536,358 | B1 * | 3/2003 | Fears | 108/116 |

* cited by examiner

*Primary Examiner*—Jose V. Chen

(57) ABSTRACT

A basket with extendable legs for easing the task of hanging clothes out to dry, the basket having a telescopic leg connected to a basket and a leg spring disposed within the telescopic leg to bias the telescopic leg away from the basket.

13 Claims, 4 Drawing Sheets

BASKET WITH EXTENDABLE LEGS

BACKGROUND OF THE INVENTION

1. Field of the Invention

The present embodiment of the invention relates to a basket with extendable legs for use in connection with clothes baskets. The basket with extendable legs has particular utility in connection with baskets having spring loaded extendable legs.

2. Description of the Prior Art

Basket with extendable legs are desirable for carrying clothing from one place to another and being able to stand the basket up and not have to lay it on the floor. Current clothes baskets must be set on the floor and the user must bend down to use it. A need was felt for clothes basket that had spring loaded extendable legs that would allow its user to use it without having to bend down.

The use of clothes baskets is known in the prior art. For example, U.S. Pat. No. 1,917,903 to Sargent discloses a basket has foldable legs and curved longitudinal slides mounted to the ends of the basket. The legs are connected to the slides whereby movement of the slides upwardly causes the legs to extend. Springs retract the legs. Means on the basket are adapted to be engaged by the slides. The slides are sprung inwardly at their upper ends to automatically engage the means on the basket. However, the Sargent '903 patent does not have spring loaded telescoping legs.

Similarly, U.S. Pat. No. 4,424,912 to Bieri et al. has a container with extendable legs can be erected to a position in which the basket is supported above a floor. The legs can be collapsed to allow the basket to rest on a floor without being supported by the legs. This erection and collapse of the legs is accomplished by handles located adjacent to the regions where the basket is grasped by a user, so that it is not necessary to let go of the basket to operate the legs. The invention is provided with various devices that prevent the legs from collapsing, once erected, unless such collapse is desired. Additionally, a special bearing is disclosed which is designed for use in this invention. However, the Bieri et al. '912 patent does not have spring loaded telescoping legs.

Lastly, U.S. Pat. No. 1,199,714 to Sargent discloses a clothes basket cross has cleats secured to its bottom. Legs are pivotally secured to the cleats in pairs and springs are connected to the legs to draw them into a folded position on the bottom of the basket. A spring latch securely connects one end with each bottom cleat of the basket and the other end is slidingly connected. A catch is located near the sliding end of each latch, and means connected with the legs engage the catches when legs are in extended position. However, the Sargent '714 patent does not have spring loaded telescoping legs.

While the above-described devices fulfill their respective, particular objectives and requirements, the aforementioned patents do not describe a basket with extendable legs that allows baskets having spring loaded extendable legs. The Sargent '903, Bieri et al. '912 and Sargent '714 patents make no provision for spring loaded telescoping legs.

Therefore, a need exists for a new and improved basket with extendable legs which can be used for baskets having spring loaded extendable legs. In this regard, the present embodiment of the invention substantially fulfills this need. In this respect, the basket with extendable legs according to the present embodiment of the invention substantially departs from the conventional concepts and designs of the prior art, and in doing so provides an apparatus primarily developed for the purpose of baskets having spring loaded extendable legs.

SUMMARY OF THE INVENTION

In view of the foregoing disadvantages inherent in the known types of clothes baskets now present in the prior art, the present embodiment of the invention provides an improved basket with extendable legs, and overcomes the above-mentioned disadvantages and drawbacks of the prior art. As such, the general purpose of the present embodiment of the invention, which will be described subsequently in greater detail, is to provide a new and improved basket with extendable legs and method which has all the advantages of the prior art mentioned heretofore and many novel features that result in a basket with extendable legs which is not anticipated, rendered obvious, suggested, or even implied by the prior art, either alone or in any combination thereof.

To attain this, the present embodiment of the invention essentially comprises a basket having a telescopic leg connected to a basket and a leg spring disposed within the telescopic leg to bias said telescopic leg away from the basket.

There has thus been outlined, rather broadly, the more important features of the embodiment of the invention in order that the detailed description thereof that follows may be better understood and in order that the present contribution to the art may be better appreciated.

The present embodiment of the invention may also include a latch pin, a latch pin spring, a handle, a lever, a cable, a cable guide, a storage bin and a lid. There are, of course, additional features of the present embodiment of the invention that will be described hereinafter and which will form the subject matter of the claims attached.

Numerous objects, features and advantages of the present embodiment of the invention will be readily apparent to those of ordinary skill in the art upon a reading of the following detailed description of presently preferred, but nonetheless illustrative, embodiments of the present embodiment of the invention when taken in conjunction with the accompanying drawings. In this respect, before explaining the current embodiment of the embodiment of the invention in detail, it is to be understood that the embodiment of the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present embodiment of the invention.

It is therefore an object of the present embodiment of the invention to provide a new and improved basket with extendable legs that has all of the advantages of the prior art clothes baskets and none of the disadvantages.

It is another object of the present embodiment of the invention to provide a new and improved basket with extendable legs that may be easily and efficiently manufactured and marketed.

An even further object of the present embodiment of the invention is to provide a new and improved basket with extendable legs that has a low cost of manufacture with regard to both materials and labor, and which accordingly is then susceptible of low prices of sale to the consuming public, thereby making such basket with extendable legs economically available to the buying public.

Still another object of the present embodiment of the invention is to provide a new basket with extendable legs that provides in the apparatuses and methods of the prior art some of the advantages thereof, while simultaneously overcoming some of the disadvantages normally associated therewith.

Lastly, it is an object of the present embodiment of the invention is to provide a basket with extendable legs for baskets having spring loaded, telescopic extendable legs.

These together with other objects of the embodiment of the invention, along with the various features; of novelty that characterize the embodiment of the invention, are pointed out with particularity in the claims annexed to and forming a part of this disclosure. For a better understanding of the embodiment of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The embodiment of the invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
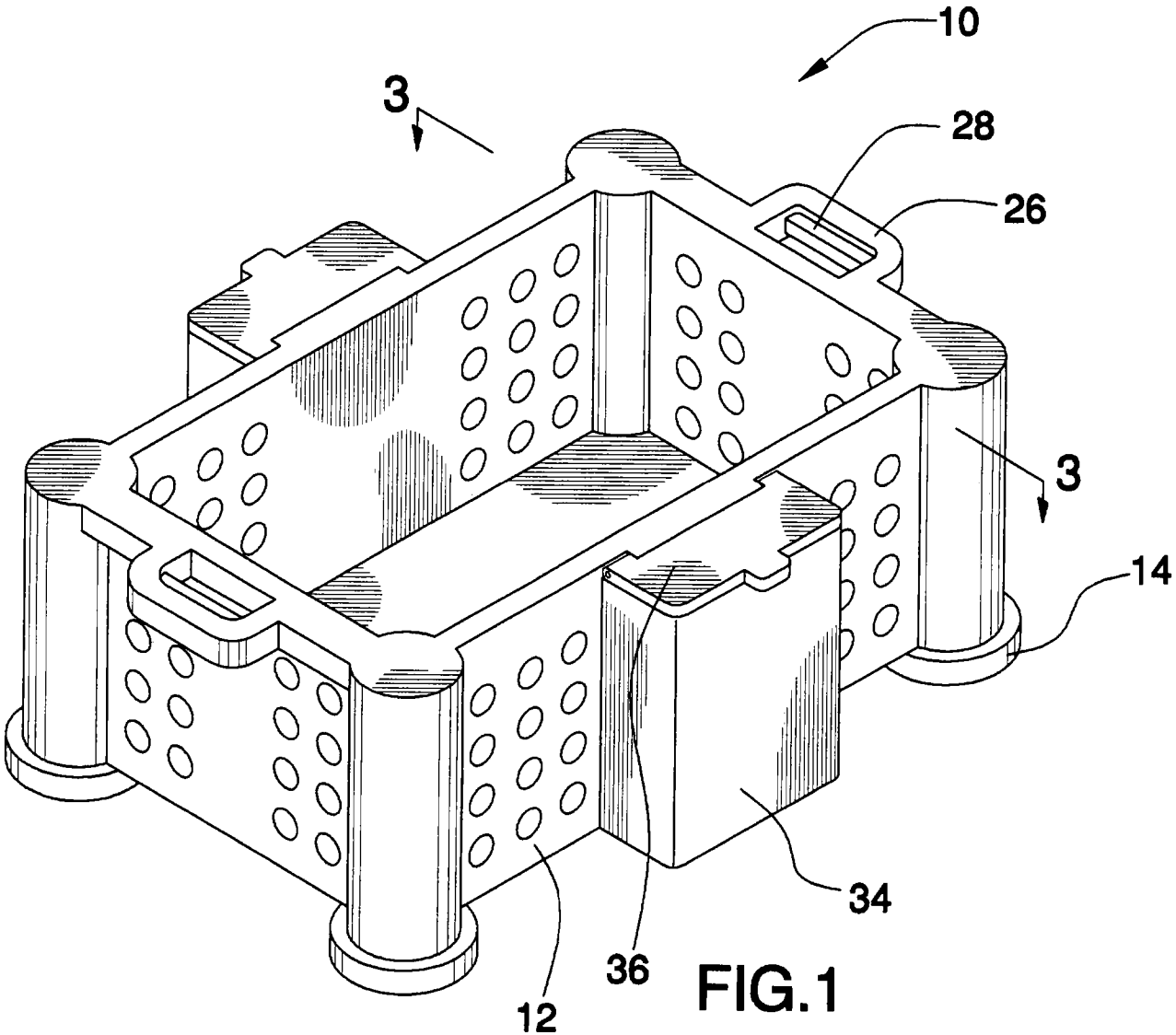
FIG. 1 is a top perspective view of the preferred embodiment of the basket with extendable legs constructed in accordance with the principles of the present invention.

Referring now to the drawings, and particularly to FIGS. 1-4, a preferred embodiment of the basket with extendable legs of the present invention is shown and generally designated by the reference numeral 10.

In FIG. 1, a new and improved basket with extendable legs 10 of the present invention for baskets having spring loaded extendable legs is illustrated and will be described. More particularly, the basket with extendable legs 10 has a basket 12 which is comprised of plastic in the present example. A telescopic leg 14 is connected to the basket 12. A handle 26 is connected to the basket 12. A lever 28 is slidably connected to the handle 26. A storage bin 34 is connected to the basket. A lid 36 is hingably connected to the storage bin 34. In the present example the basket measures approximately 32 inches high, 20 inches long and 12 inches wide.

Figure 2:
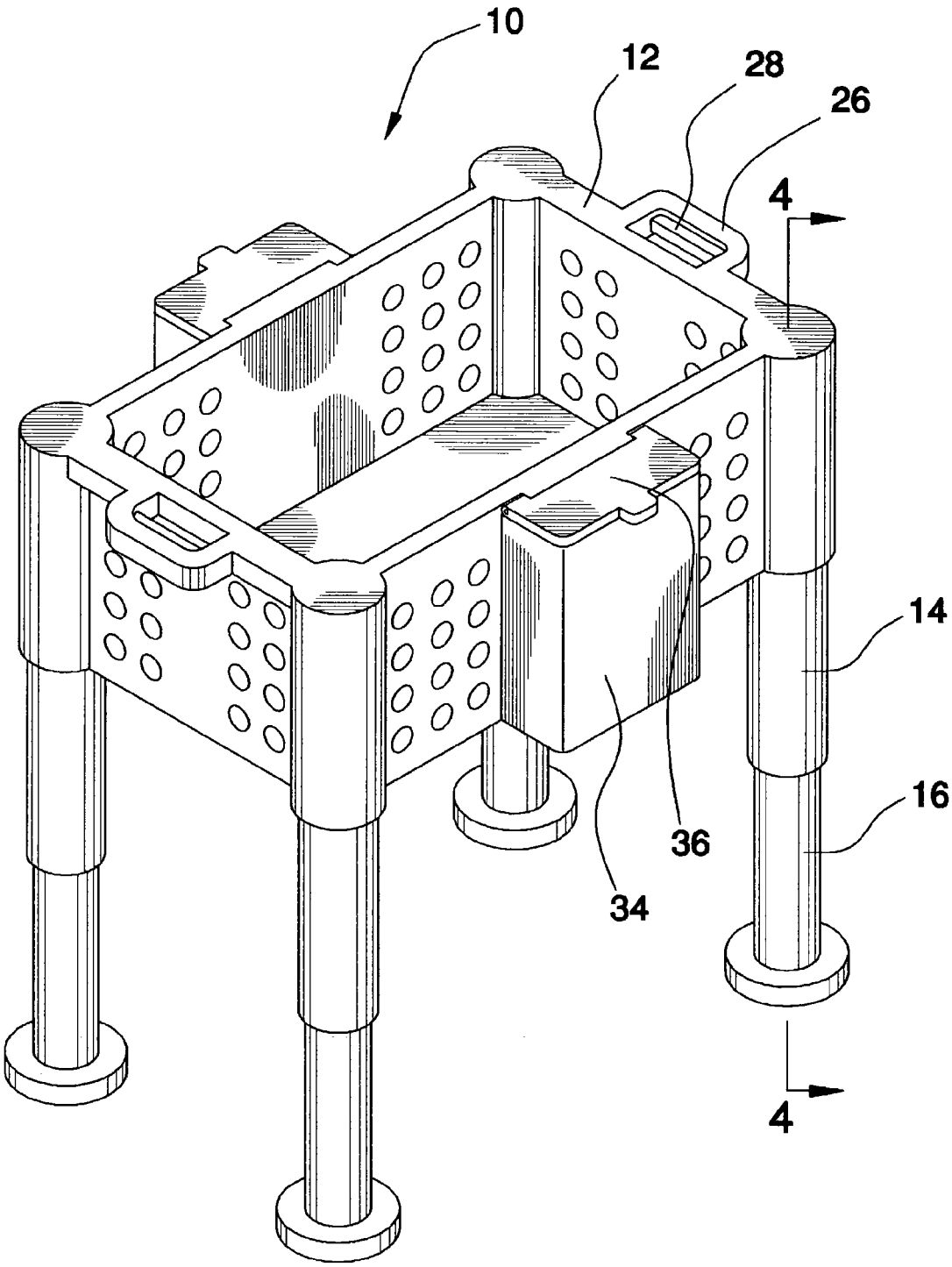
FIG. 2 is a top perspective view of the basket with extendable legs of the present embodiment of the invention.

In FIG. 2, the basket with extendable legs 10 is illustrated and will be described. More particularly, the basket with extendable legs 10 has the basket 12 which is comprised of plastic in the present example. The telescopic leg 14 is connected to the basket 12. The handle 26 is connected to the basket 12. The lever 28 is slidably connected to the handle 26. The storage bin 34 is connected to the basket. The lid 36 is hingably connected to the storage bin 34.

Figure 3:
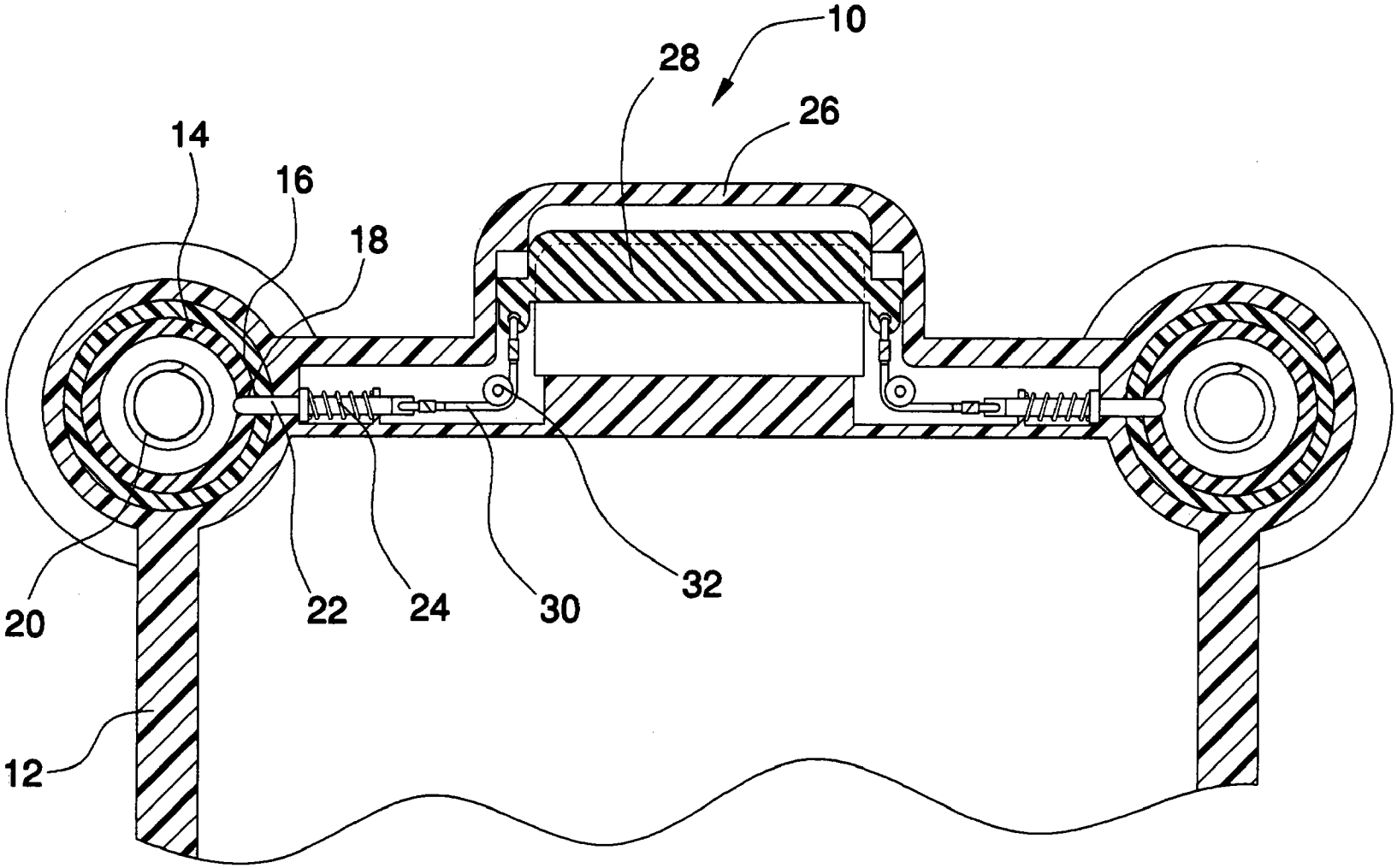
FIG. 3 is a section 3-3 view of FIG. 1 of the basket with extendable legs of the present embodiment of the invention.

In FIG. 3, the basket with extendable legs 10 is illustrated and will be described. More particularly, the basket with extendable legs 10 has the basket 12. The telescopic leg 14 is connected to the basket 12. The telescopic leg 14 has a side-wall 16. The telescopic leg side-wall 16 has a retaining bore 18 therethru. A leg spring 20 is disposed within the telescopic leg 14 to bias the telescopic leg 14 away from the basket 12. A latch pin 22 is slidably connected to the basket 12. The latch pin 22 is capable of engaging the telescopic leg side-wall retaining bore 18. A latch pin spring 24 biases the latch pin 22 toward the telescopic leg side wall retaining bore 18. The handle 26 is connected to the basket 12. The lever 28 is slidably connected to the handle 26. A cable 30 is connected to the lever 28. The cable 30 is connected to the latch pin 22. A cable guide 32 is rotatably connected to the basket 12. The cable guide 32 is rotatably connected to the cable 30.

Figure 4:
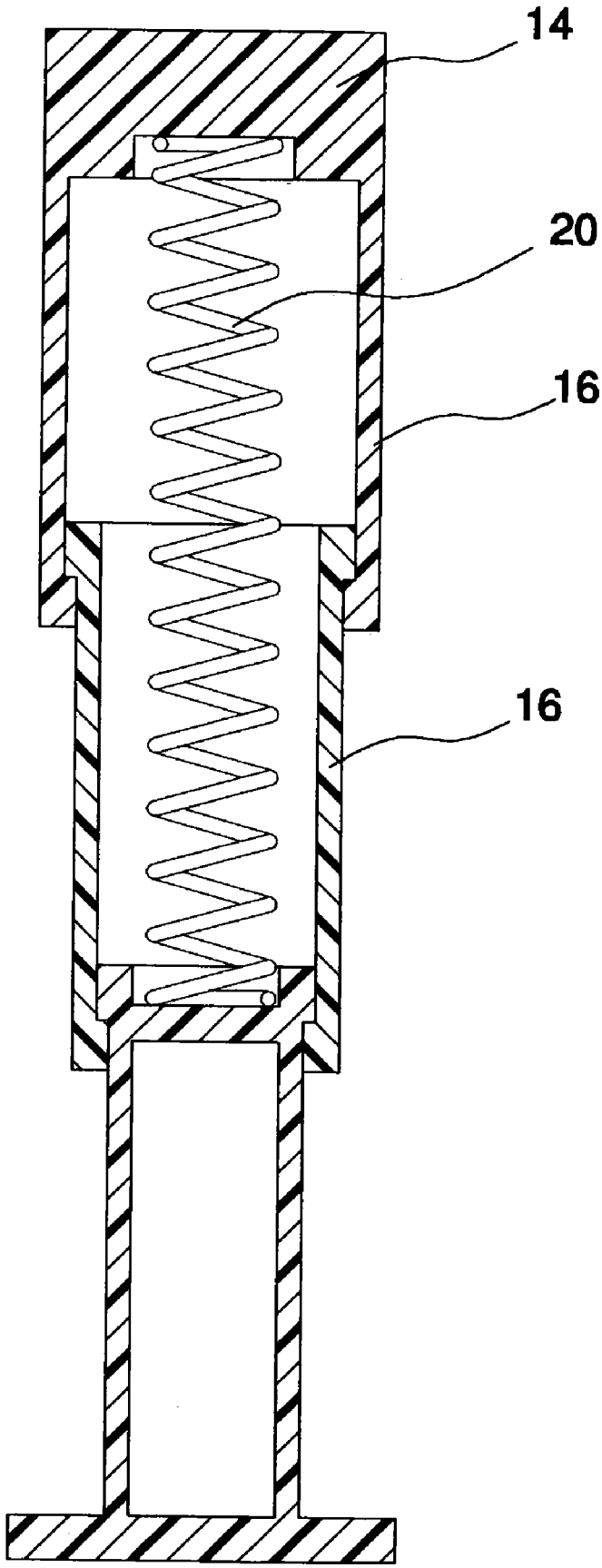
FIG. 4 is a section 4-4 view of FIG. 2 of the basket with extendable legs of the present embodiment of the invention.

In FIG. 4, the basket with extendable legs 10 is illustrated and will be described. More particularly, the basket with extendable legs 10 has the basket 12. The telescopic leg 14 is connected to the basket 12. The telescopic leg 14 has the side-wall 16. The leg spring 20 is disposed within the telescopic leg 14 to bias the telescopic leg 14 away from the basket 12.

In use it can now be understood that to use the basket with extendable legs 10, the user would simply squeeze the lever 28 and the legs would extend downward. To retract the legs the user would simply squeeze the lever 28 and push the basket 12 downward until the latch pin 22 engaged the telescopic leg side wall retaining bore 18 and the telescopic legs 14 locked in place.

While a preferred embodiment of the basket with extendable legs has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present embodiment of the invention. For example, any suitable sturdy material such as metal, or a variety of wood may be used instead of the plastic basket described. Also, the plastic telescoping legs may also be made of wood, or metal. And although baskets having spring loaded extendable legs have been described, it should be appreciated that the basket with extendable legs herein described is also suitable for use as a portable table.

Therefore, the foregoing is considered as illustrative only of the principles of the embodiment of the invention. Further, since numerous modifications and changes will readily occur to those skilled in the art, it is not desired to limit the embodiment of the invention to the exact construction and operation shown and described, and accordingly, all suitable modifications and equivalents may be resorted to, falling within the scope of the embodiment of the invention.

We claim:

1. A basket with extendable legs comprising:

a basket;

a telescopic leg connected to said basket, said telescopic leg has a side-wall, said telescopic leg side-wall having a retaining bore therethru;

a leg spring disposed within said telescopic leg to bias said telescopic leg away from said basket;

a latch pin connected to said basket, said latch pin capable of engaging said telescopic leg side-wall retaining bore.

2. The basket with extendable legs of claim 1 further comprising:

a latch pin spring biasing said latch pin toward said telescopic leg side wall retaining bore.

3. The basket with extendable legs of claim 2 further comprising:

a handle connected to said basket; and a lever slidably connected to said handle.

4. The basket with extendable legs of claim 3 further comprising:

a cable connected to said lever, said cable connected to said latch pin.

5. The basket with extendable legs of claim 4 further comprising:

a cable guide rotatably connected to said basket, said cable guide rotatably connected to said cable.

6. A basket with extendable legs comprising:

a basket;

a telescopic leg connected to said basket, said telescopic leg has a side-wall, said telescopic leg side-wall having a retaining bore therethru;

a leg spring disposed within said telescopic leg to bias said telescopic leg away from said basket; and a latch pin slidably connected to said basket, said latch pin capable of engaging said telescopic leg side-wall retaining bore.

7. The basket with extendable legs of claim 6 further comprising:

a latch pin spring biasing said latch pin toward said telescopic leg side wall retaining bore.

8. The basket with extendable legs of claim 6 further comprising:

a handle connected to said basket.

9. The basket with extendable legs of claim 8 further comprising:

a lever connected to said handle.

10. The basket with extendable legs of claim 9 further comprising:

a cable connected to said lever, said cable connected to said latch pin.

11. The basket with extendable legs of claim 10 further comprising:

a cable guide rotatably connected to said basket, said cable guide rotatably connected to said cable.

12. The basket with extendable legs of claim 11 further comprising:

a storage bin connected to said basket; and a lid hingably connected to said storage bin.

13. A basket with extendable legs comprising:

a basket, said basket is comprised of plastic;

a telescopic leg connected to said basket, said telescopic leg has a side-wall, said telescopic leg side-wall having a retaining bore therethru;

a leg spring disposed within said telescopic leg to bias said telescopic leg away from said basket;

a latch pin slidably connected to said basket, said latch pin capable of engaging said telescopic leg side-wall retaining bore;

a latch pin spring biasing said latch pin toward said telescopic leg side wall retaining bore;

a handle connected to said basket;

a lever slidably connected to said handle;

a cable connected to said lever, said cable connected to said latch pin;

a cable guide rotatably connected to said basket, said cable guide rotatably connected to said cable;

a storage bin connected to said basket; and a lid hingably connected to said storage bin.

* * * * *